US012637865B2

(12) United States Patent
Rummel et al.

(10) Patent No.: US 12,637,865 B2
(45) Date of Patent: May 26, 2026

(54) FLOOR PENETRATION COVER

(71) Applicant: Clayton Supply, Inc., Maryville, TN (US)

(72) Inventors: Aaron Rummel, Knoxville, TN (US); John Weldy, Wakarusa, IN (US); Joel Gavin Mabe, Knoxville, TN (US)

(73) Assignee: Clayton Supply, Inc., Maryville, TN (US)

( * ) Notice: Subject to any disclaimer, the term of this patent is extended or adjusted under 35 U.S.C. 154(b) by 224 days.

(21) Appl. No.: 18/411,132

(22) Filed: Jan. 12, 2024

(65) Prior Publication Data

US 2025/0230669 A1 Jul. 17, 2025

(51) Int. Cl.
*E04F 15/02* (2006.01)

(52) U.S. Cl.
CPC ..... *E04F 15/02005* (2013.01)

(58) Field of Classification Search
CPC . E04F 15/02188; E04F 19/08; E04F 2290/02; A47K 3/1615
See application file for complete search history.

(56) References Cited

U.S. PATENT DOCUMENTS 6,912,815 B1 * 7/2005 Koehler ..... A01G 13/105 52/101
D648,819 S * 11/2011 Bronk ..... D22/122
8,342,923 B2 * 1/2013 Mavroudis ..... F24F 13/082 454/307
11,505,930 B2 * 11/2022 Meyers ..... E03F 5/0408
11,535,417 B2 * 12/2022 Tibbets ..... B65D 1/34
2003/0051894 A1 * 3/2003 Westlake ..... H02G 3/14 174/66
2011/0056153 A1 * 3/2011 Plyler ..... E02D 31/02 52/742.14
2014/0260007 A1 * 9/2014 Schlabach ..... E04D 13/0305 52/200
2014/0317841 A1 * 10/2014 DeJesus ..... A47K 3/40 52/741.41
2014/0319833 A1 * 10/2014 DeJesus ..... F16L 23/12 264/258

FOREIGN PATENT DOCUMENTS

CH 708365 B1 * 4/2017 ..... E04F 19/08

* cited by examiner

*Primary Examiner* — Christine T Cajilig
(74) *Attorney, Agent, or Firm* — Luedeka Neely, P.C.

(57) ABSTRACT

A cover for sealing floor penetrations formed from a unitary, continuous piece of thermoplastic material having a rim portion and a recessed portion. The rim portion forms a flange having an outer edge, and the recessed portion extends downward from the rim portion and defines a cavity. The flange portion extends past the floor penetration to contact and rest on the floor, and adhesive layers may be used to create a seal between the cover and the floor.

6 Claims, 4 Drawing Sheets

FLOOR PENETRATION COVER

FIELD

This disclosure generally relates to the field of structures covering openings in the floors of manufactured homes. More particularly, this disclosure is directed to a cover for sealing an opening between a floor and subfloor, facilitating the installation of various building components.

BACKGROUND

Manufactured homes are dwellings assembled partially or entirely at an off-site manufacturing facility and then relocated to a piece of property, where they may be installed either permanently or temporarily. Off-site assembly significantly streamlines and speeds the building process, but the modularity of the assembly process may also create new challenges in some cases due to the order of assembly.

One particular challenge is the installation of building components such as plumbing systems, which may be installed after flooring. Certain plumbing components such as "p-traps" rely on an elevation change to create a barrier between the sewer system to which the manufactured home is connected and the interior of the home. Often, builders must cut an opening or "floor penetration" in the flooring to access the subfloor and install the components. It is advantageous to seal the floor penetrations for several reasons; sealing the floor penetration allows for leak detection and creates an air and moisture barrier between subfloor, which may or may not be open to the environment, and the interior of the home. Moreover, various home energy efficiency certification programs, such as the Department of Energy's Zero Energy Ready program require all such floor penetrations to be sealed to meet minimum requirements.

Accordingly, what is desired is an easy-to-use, low-cost structure for sealing floor penetrations that also allows for easy installation and maintenance of various building components.

SUMMARY

The above and other needs are met by a cover for sealing floor penetrations in a manufactured home.

In one embodiment, a cover is disclosed that is configured to be placed over the floor penetration, the cover having an upper surface and opposing lower surface, as well as a rim portion and a recessed portion. The rim portion forms a flange having an outer edge, and the recessed portion extends downward from the rim portion and defines a cavity.

In some embodiments, the cavity has a rounded or dome-like shape.

In some embodiments, the outer edge of the flange may have several sides. In some variations, the outer edge may have four sides.

In some embodiments, the rim portion is dimensioned and configured such that the outer edge of the flange extends over the penetration and the lower surface of the rim portion contacts the floor. In some variations of these embodiments, the apparatus may further comprise one or more adhesive layers disposed over the upper surface of the outer edge of the flange and the floor, thereby creating a seal between the cover and the floor, creating an air and moisture barrier between the interior of the home and the portion of the home accessed through the floor penetration. The adhesive layers may be tape, in some variations one-sided adhesive sealing tape.

In some embodiments, the rim portion and the recessed portion comprise a unitary structural element.

In some embodiments, the rim portion and recessed portion are formed from a continuous piece of thermoplastic material. In some variations of these embodiments, the thermoplastic material may be colorless. In other variations, the thermoplastic material may be substantially transparent.

In some embodiments, the cover may formed from a polymeric material selected from polyvinyl chloride, polyethylene, polypropylene, or other similar suitable materials.

In another embodiment, a method is disclosed for sealing a penetration in the floor of a manufactured home including the step of providing a cover having an upper surface and opposing lower surface, as well as a rim portion and a recessed portion. The rim portion forms a flange having an outer edge, and the recessed portion extends downward from the rim portion and defines a cavity. The method further includes the step of positioning the cover over the penetration in the floor such that the outer edge of the flange extends over the penetration and the lower surface of the rim portion contacts the floor, the recessed portion extending through the penetration in the floor, the cavity being at least partially disposed below the floor.

In some embodiments, the method further includes the step of disposing one or more adhesive layers on the upper surface of the outer edge of the flange and the floor, thereby creating a seal between the cover and the floor. In some variations of these embodiments, the adhesive layers may be tape, in some variations one-sided adhesive sealing tape.

In some embodiments, the cover may formed from a polymeric material selected from polyvinyl chloride, polyethylene, polypropylene, or other similar suitable materials.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
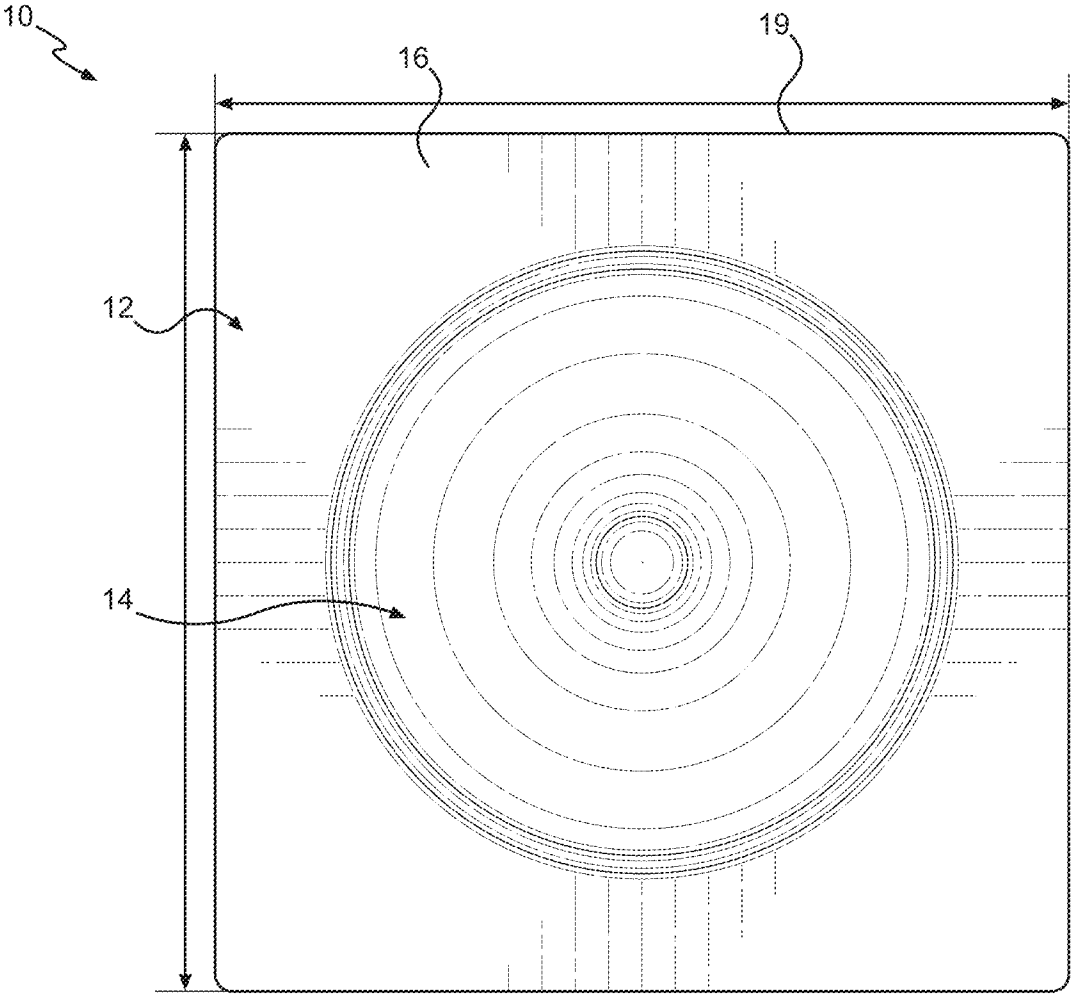
FIG. 1 is a top perspective view of a floor penetration cover in accordance with one embodiment of the present disclosure.
Figure 2:
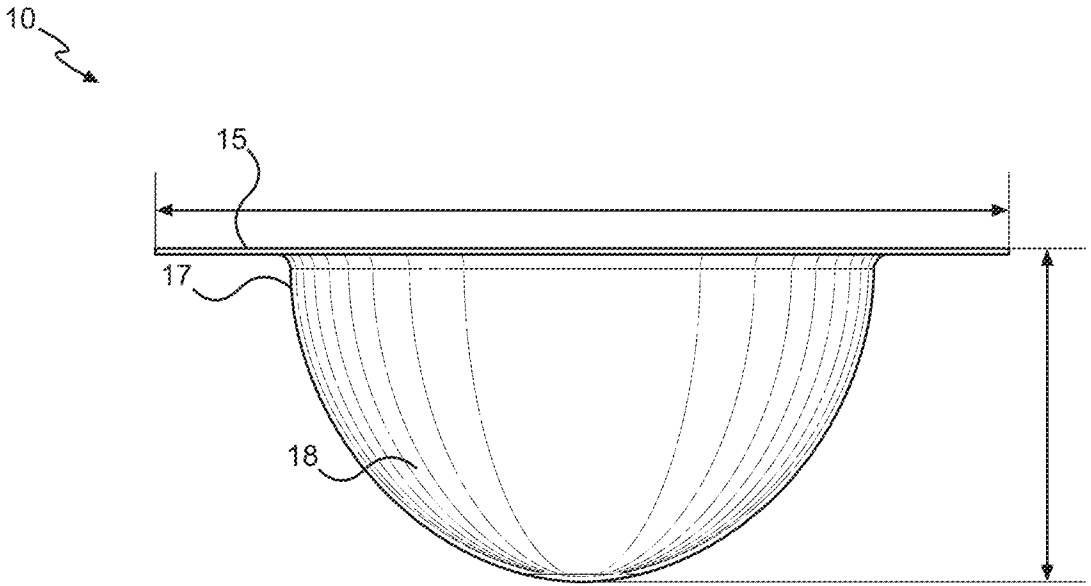
FIG. 2 is a side perspective view of a floor penetration cover in accordance with one embodiment.
Figure 3:
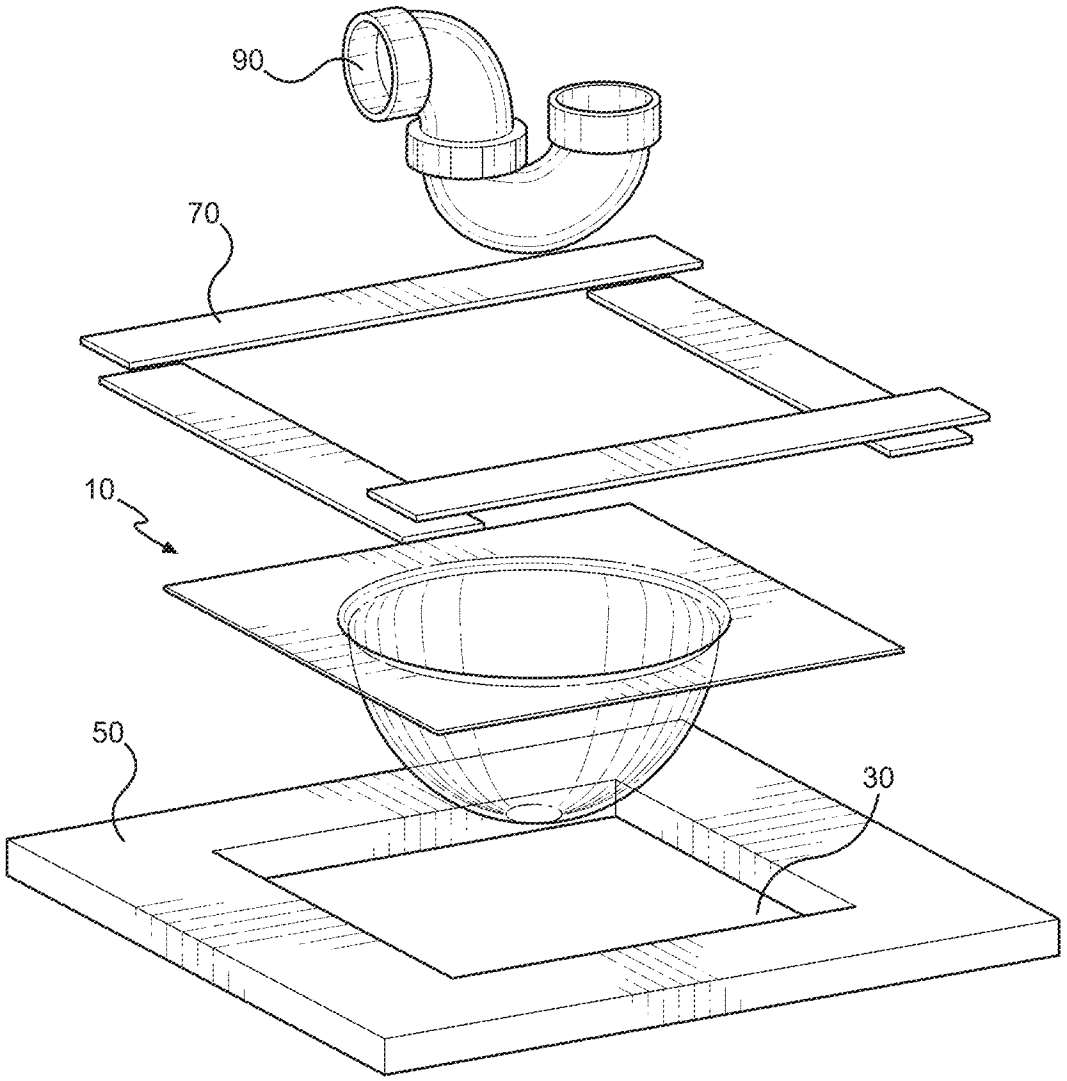
FIG. 3 is an exploded view of a floor penetration, a floor penetration cover, adhesive layer, and an exemplary p-trap in accordance with one embodiment.
Figure 4:
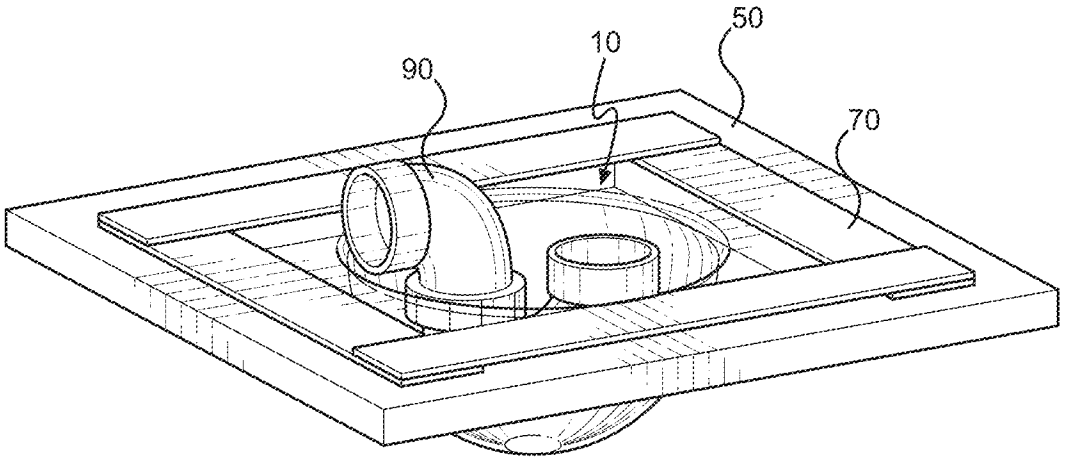
FIG. 4 is an assembled view of a floor penetration, a floor penetration cover, adhesive layer, and an exemplary p-trap in accordance with one embodiment.

Depicted in FIGS. 1-4 is a floor penetration cover ("cover") 10 for sealing a floor penetration 30 in a floor 50. Shown in FIGS. 3 and 4, the floor penetration cover 10 may be used along with adhesive layers 70 to seal floor penetrations 30 for installation of various building components such as a p-trap 90, for example. As one skilled in the art will appreciate, the floor penetration cover 10 may be used to seal floor penetrations 30 required for many other such building components.

The cover 10 preferably includes two portions, a rim portion 12 and a recessed portion 14, the rim portion 12 extending horizontally out from the top of the recessed portion 14 to form a flange 16 having an outer edge 19 that may take a variety of shapes. The cover 10 further includes an upper surface 15 and a lower surface 17. Preferably, shown in FIGS. 1-4, the outer edge 19 may form a shape having four corners and four sides, such as a square. In other embodiments, the outer edge 19 may take a circular or oval shaped form—or that of any other shape. The shape of the outer edge 19 may depend on either or both of the shapes of the recessed portion 14 and the floor penetration 30 desired to be sealed by placing the cover 10 overtop.

The recessed portion 14 extends downward from the plane of the flange 16 to define a cavity 18. Preferably, shown in FIGS. 1-4, the cavity 18 may take a sloping, dome-like shape. In other embodiments, the cavity 18 may take any variety of desire shapes for the particular application, including flat walls to form more squared or rectangular shapes—or that of any other shape. The shape of the cavity 18 may depend on either or both of the shapes of the floor penetration 30 and the building components desired to be housed at least partially within the recessed portion 14, such as a p-trap 90.

In use, the cover 10 is aligned over a floor penetration 30 desired to be sealed and lowered down so that the recessed portion 14 is at least partially inserted within the floor penetration 30. In some embodiments, the lower surface 17 of the cover 10 may contact the floor 50 surrounding the floor penetration 30. In some applications, the cover 10 may sufficiently seal the floor penetration 30 merely by being placed over it. In other applications, the cover 10 may be combined with various other sealing means, such as adhesives. In some embodiments, liquid adhesive or double-sided adhesive sealing tape may be applied to the lower surface 17 of the cover 10 prior to installation of the cover 10 on the floor 50 in order to form an air and moisture resistant barrier between the floor 90 and subfloor of the home. In other preferred embodiments shown in FIGS. 3 and 4, the adhesive layers 70 may be one-sided adhesive sealing tape, such as for example OX Seam Tape, placed on the upper surface 15 of the cover 10 around the outer edge 19 of the flange 16 to form the desired seal. In some embodiments, the adhesive layers 70 may be applied in multiple strips. In other embodiments, the adhesive layers 70 may be shaped or cut beforehand to fit certain outer edge 19 shapes, such as when the outer edge 19 is circular. After the cover 10 is aligned and sealed, building components like a p-trap 90 may be placed within the cavity 18.

In the preferred embodiment of the disclosure, both the rim portion 12 and recessed portion 14 of the cover 10 are a unitary structural element formed from one continuous piece of thermoplastic material, such as polyvinyl chloride, polyethylene, polypropylene, or other similar suitable materials. Preferably, the thermoplastic material is colorless and substantially transparent. Thus, when used in applications such as for p-traps 90 or other plumbing components, the cover 10 seals the floor penetration 30, allows for the detection of leaks in plumbing from above and below—useful when building manufactured homes—and acts as catchment in the case of a leak, preventing destruction of the underlying floor and subfloor and allowing removal and service of the p-trap or other building or plumbing components. As one skilled in the art will appreciate, the cover 10 as depicted in the FIGS. 1-4 is designed to be formed using an injection molding process in a two-piece injection mold.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A method for sealing a penetration in a floor of a manufactured home adjacent a p-trap, the method comprising:

providing a cover having an upper surface and an opposing lower surface, a rim portion forming a flange having an outer edge, and a recessed portion extending downward from the rim portion defining a cavity; and positioning the cover over the penetration in the floor of the manufactured home adjacent the p-trap such that the outer edge of the flange extends over the penetration and the lower surface of the rim portion contacts the floor and the recessed portion extends through the penetration in the floor, the cavity being at least partially disposed below the floor, wherein a portion of the p-trap is located within the cavity.

2. The method of claim 1 further comprising the step of disposing one or more adhesive layers on the lower surface of the flange, the floor, or both, and thereby creating a seal between the cover and the floor.

3. The method of claim 2 wherein the adhesive layer is a one-sided adhesive sealing tape.

4. The method claim 1 wherein the cover is polymeric, and the and the polymer of the cover is selected from the group consisting of polyvinyl chloride, polyethylene, or polypropylene.

5. A method for sealing a penetration adjacent a p-trap in a floor of a manufactured home, the method comprising:

providing a cover having an upper surface and an opposing lower surface, a rim portion forming a flange having an outer edge, and a recessed portion extending downward from the rim portion defining a dome-shaped cavity, wherein the cover is substantially transparent; and positioning the cover adjacent the penetration in the floor such that the upper surface of the rim portion contacts the floor and the recessed portion extends away from the penetration such the cavity is disposed below the floor, and wherein the cavity is adjacent the p-trap, and further wherein the cavity is configured to act as a catchment for water leaking from the p-trap and the cavity is also configured to allow visible detection of leaks visible through the cover.

6. The method of claim 5 further comprising the step of disposing one or more adhesive layers on the upper surface of the flange, the floor, or both, and thereby creating a seal between the cover and the floor.

* * * * *